US007438197B2

(12) United States Patent
Yamauchi

(10) Patent No.: US 7,438,197 B2
(45) Date of Patent: Oct. 21, 2008

(54) COMBINED MODULE OF FOLDING CONTAINER

(75) Inventor: Hisatoshi Yamauchi, Mizuho (JP)

(73) Assignee: Sanko Co., Ltd., Gifu (JP)

( * ) Notice: Subject to any disclaimer, the term of this patent is extended or adjusted under 35 U.S.C. 154(b) by 314 days.

(21) Appl. No.: 10/761,379

(22) Filed: Jan. 22, 2004

(65) Prior Publication Data

US 2004/0226946 A1 Nov. 18, 2004

(30) Foreign Application Priority Data

May 12, 2003 (JP) ..... 2003-132828

(51) Int. Cl.
*B65D 6/00* (2006.01)
*B65D 25/54* (2006.01)
*B65D 90/02* (2006.01)

(52) U.S. Cl. ..... 220/7; 220/605; 215/371

(58) Field of Classification Search ..... 220/7, 220/6, 606; 215/371–375
See application file for complete search history.

(56) References Cited

U.S. PATENT DOCUMENTS

| | | | | |
|---|---|---|---|---|
| 3,498,494 | A * | 3/1970 | Voorhees, Jr. | 206/501 |
| 4,491,231 | A * | 1/1985 | Heggeland et al. | 220/6 |
| 4,591,065 | A * | 5/1986 | Foy | 220/7 |
| 4,662,532 | A * | 5/1987 | Anderson et al. | 220/7 |
| 5,671,857 | A * | 9/1997 | Stromberg | 220/7 |
| 5,788,103 | A * | 8/1998 | Wagner et al. | 220/6 |
| 5,797,508 | A * | 8/1998 | Loftus et al. | 220/6 |
| 6,631,822 | B1 * | 10/2003 | Overholt | 220/7 |
| 6,691,885 | B2 * | 2/2004 | Brown | 220/7 |
| 6,776,300 | B2 * | 8/2004 | Walsh et al. | 220/6 |
| 2004/0045963 | A1 * | 3/2004 | Hoogland | 220/6 |
| 2004/0159659 | A1 * | 8/2004 | Rumpel | 220/7 |
| 2004/0178197 | A1 * | 9/2004 | Hsu et al. | 220/7 |
| 2004/0226946 | A1 * | 11/2004 | Yamauchi | 220/6 |

FOREIGN PATENT DOCUMENTS

| | | | |
|---|---|---|---|
| JP | 2002-002696 | | 1/2002 |
| JP | 2002-046736 | A | 2/2002 |
| JP | 2002-128071 | A | 5/2002 |
| JP | 2002-240821 | A | 8/2002 |
| JP | 2002-321739 | A | 11/2002 |
| JP | 2002321739 | A * | 11/2002 |

OTHER PUBLICATIONS

European Search Report dated Aug. 31, 2004, issued in corresponding European Patent Application No. 04 00 0242.

* cited by examiner

*Primary Examiner*—Anthony D Stashick
*Assistant Examiner*—Shawn M. Braden
(74) *Attorney, Agent, or Firm*—Westerman, Hattori, Daniels & Adrian, LLP.

(57) ABSTRACT

In a combined module of a folding container, long-side bank portions 1*a* of a bottom 1 of a large folding container Cb are configured to be higher than short-side bank portions 1*b* of the bottom 1. Since the long-side bank portions of the bottom of the large folding container are configured to be higher than the short-side bank portions of the bottom 1, it is possible to improve the strength and rigidity of the bottom of the large folding container. Therefore, the large folding container can be prevented from being deformed or damaged by a load or twist.

1 Claim, 11 Drawing Sheets

COMBINED MODULE OF FOLDING CONTAINER

FIELD OF THE INVENTION

The present invention relates to a combined module of a large folding container comprising a bottom, long side walls hinged to corresponding long-side bank portions of the bottom, and short side walls hinged to corresponding short-side bank portions of the bottom, the long and short side walls being capable of being folded so as to overlap the bottom, and a small folding container comprising a bottom that is substantially half as large as the bottom of the large folding container, long side walls which are hinged to corresponding long-side bank portions of the bottom of the small folding container and which are each substantially as large as the short side wall of the large folding container, and short side walls which are hinged to corresponding short-side bank portions of the bottom of the small folding container and which are each substantially half as large as the long side wall of the large folding container, the long and short side walls being capable of being folded so as to overlap the bottom.

BACKGROUND OF THE INVENTION

A combined module of a folding container is conventionally known in which long-side bank portions of a bottom of a large folding container are formed to be lower than short-side bank portions of the bottom (for example, the Unexamined Japanese Patent Application Publication (Tokkai-Hei) No. 2002-2696).

In the prior art, since the long-side bank portions of the bottom of the large folding container are formed to be the lower than short-side bank portions of the bottom, the bottom of the large folding container has insufficient strength and rigidity. Consequently, the large folding container is likely to be deformed when subjected to a load or twisted. This problem is more serious if a small folding container is stacked on the large folding container.

It is an object of the present invention to solve the above problem of the conventional combined module of the folding container.

SUMMARY OF THE INVENTION

To accomplish this object, the present invention provides a combined module of a large folding container and a small folding container wherein long-side bank portions of a bottom of a large folding container are configured to be higher than short-side bank portions of the bottom.

DETAILED DESCRIPTION OF THE PREFERRED EMBODIMENTS

Figure 1:
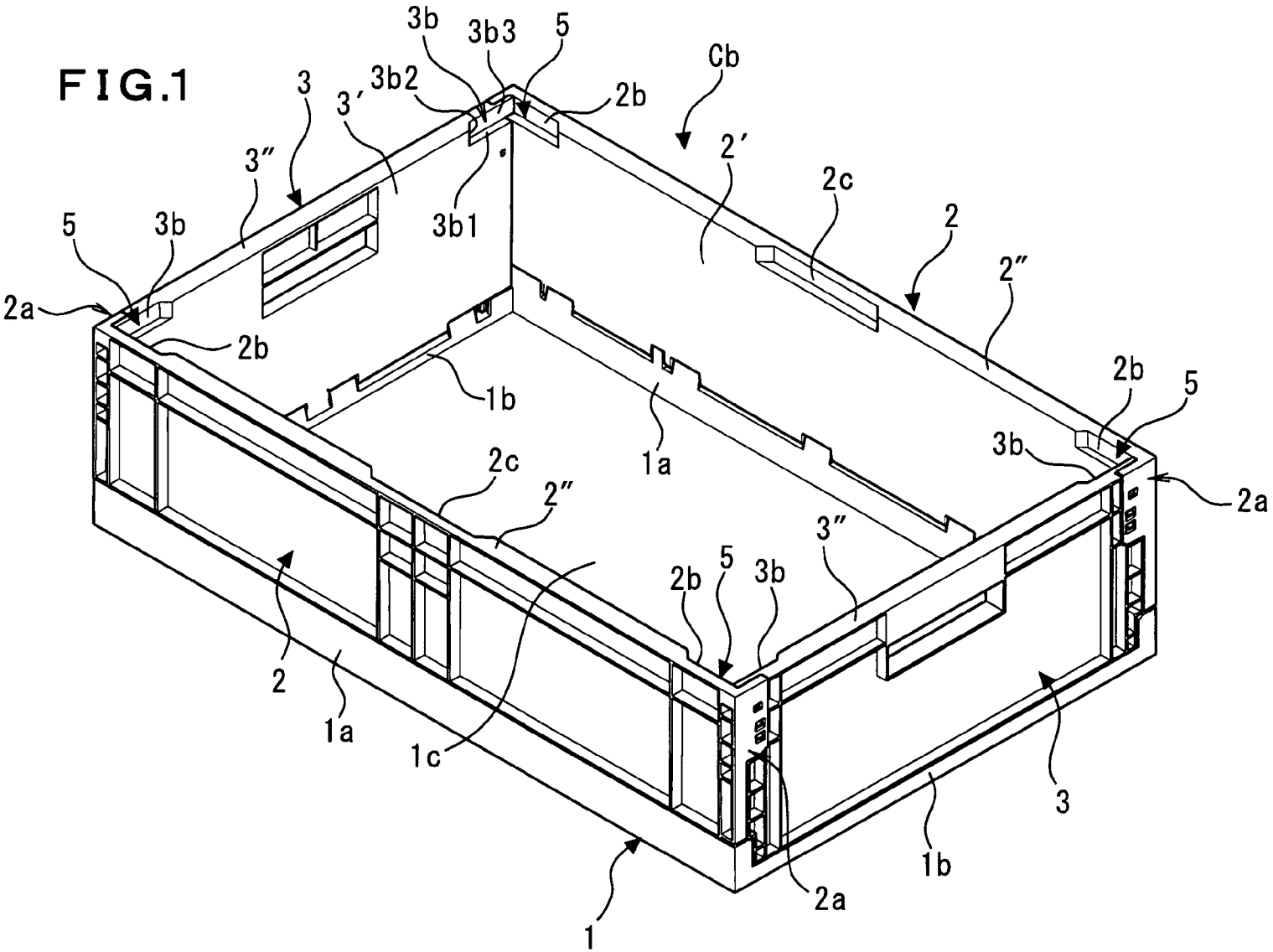
FIG. 1 is a perspective view showing that a large folding container constituting a combined module of a folding container according to the present invention has been assembled into a box shape.

An embodiment of the present invention will be described below. However, the present invention is not limited to the present embodiment. Variations may be made to the embodiment without departing from the spirits of the present invention.

First, with reference to FIGS. 1 to 5, a description will be given of a large folding container Cb constituting a combined module of a folding container.

1 is a bottom that appears rectangular in a plan view. Long side walls 2 are hinged via appropriate hinge members to corresponding opposite long-side bank portions 1*a* of the bottom 1. Short side walls 3 are also hinged via appropriate hinge members to corresponding opposite short-side bank portions 1*b* of the bottom 1. The long-side bank portions 1*a* are configured to be higher than the short-side bank portions 1*b*. The hinging portion between the bottom 1 and each long side wall 2 is located higher than the hinging portion between the bottom 1 and each short side wall 3.

Figure 2:
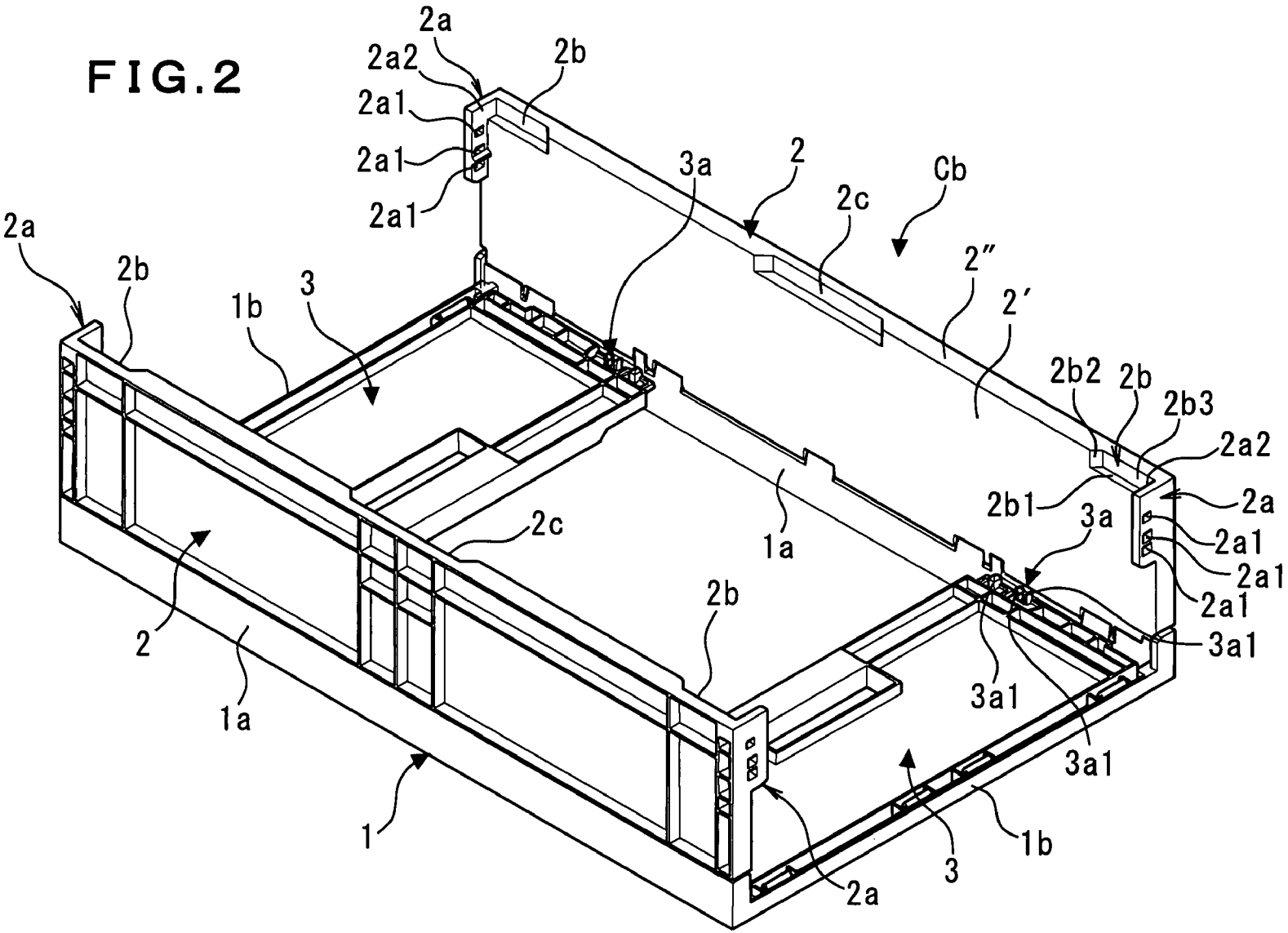
FIG. 2 is a perspective view showing that the large folding container shown in FIG. 1 is being assembled or folded.
Figure 3:
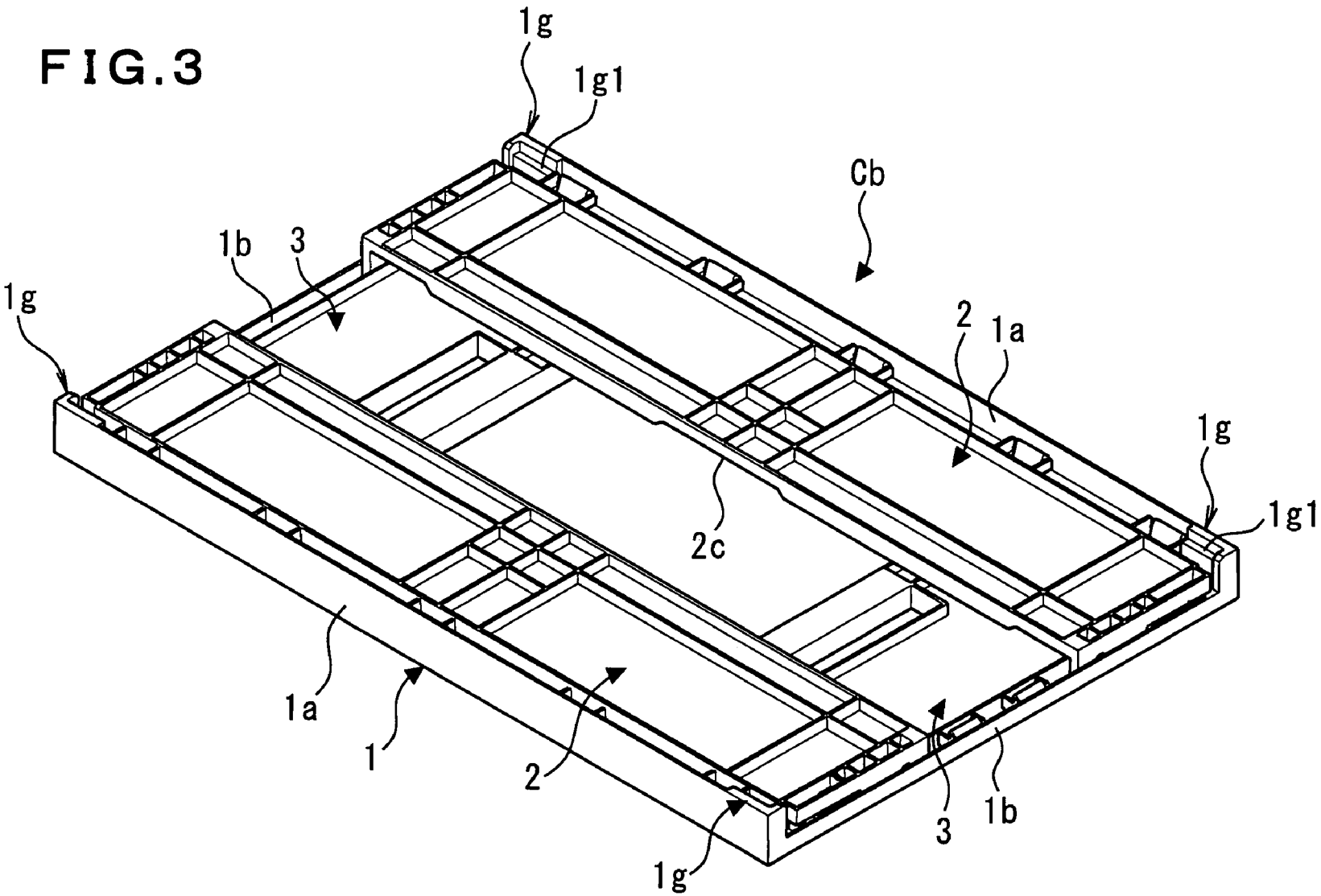
FIG. 3 is a perspective view showing that the large folding container shown in FIG. 1 has been folded.

To fold the large folding container Cb assembled into a box shape as shown in FIG. 1, the short side walls 3 are brought down to the inside of the large folding container Cb and laid on the bottom 1 as shown in FIG. 2. Then, similarly, the long side walls 2 are brought down to the inside of the large folding container Cb and laid on the bottom 1 and short side walls 3 as shown in FIG. 3. In contrast, to assemble the large folding container Cb as shown in FIG. 1, the large folding container Cb having been folded as shown in FIG. 3, the long side walls 2 laid on the bottom 1 and short side walls 3 are set up substantially perpendicularly. Then, the short side walls 3 are set up substantially perpendicularly to assemble the large folding container Cb into a box shape.

Figure 4:
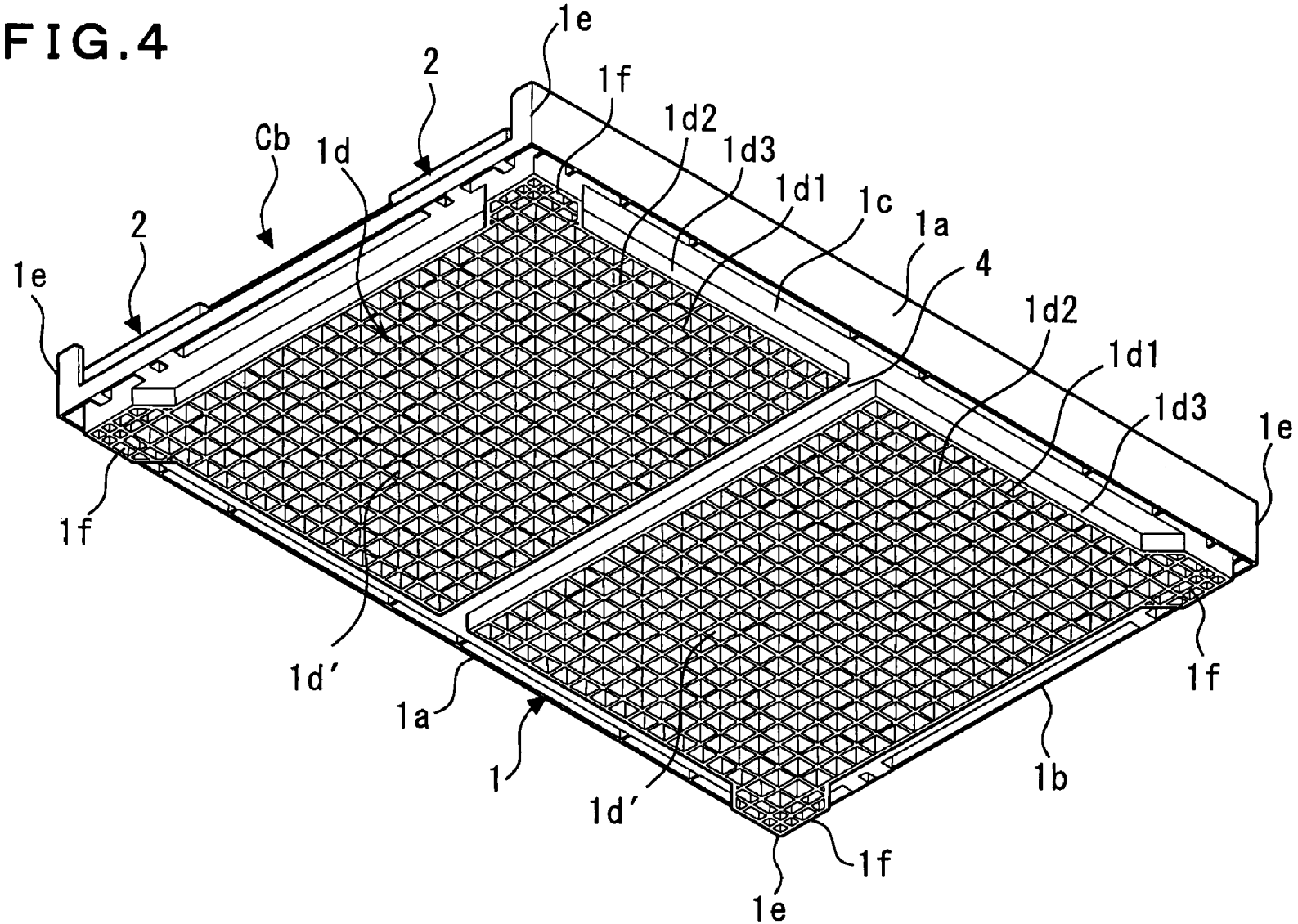
FIG. 4 is a perspective view of a back surface of a bottom of the large folding container shown in FIG. 1.
Figure 5:
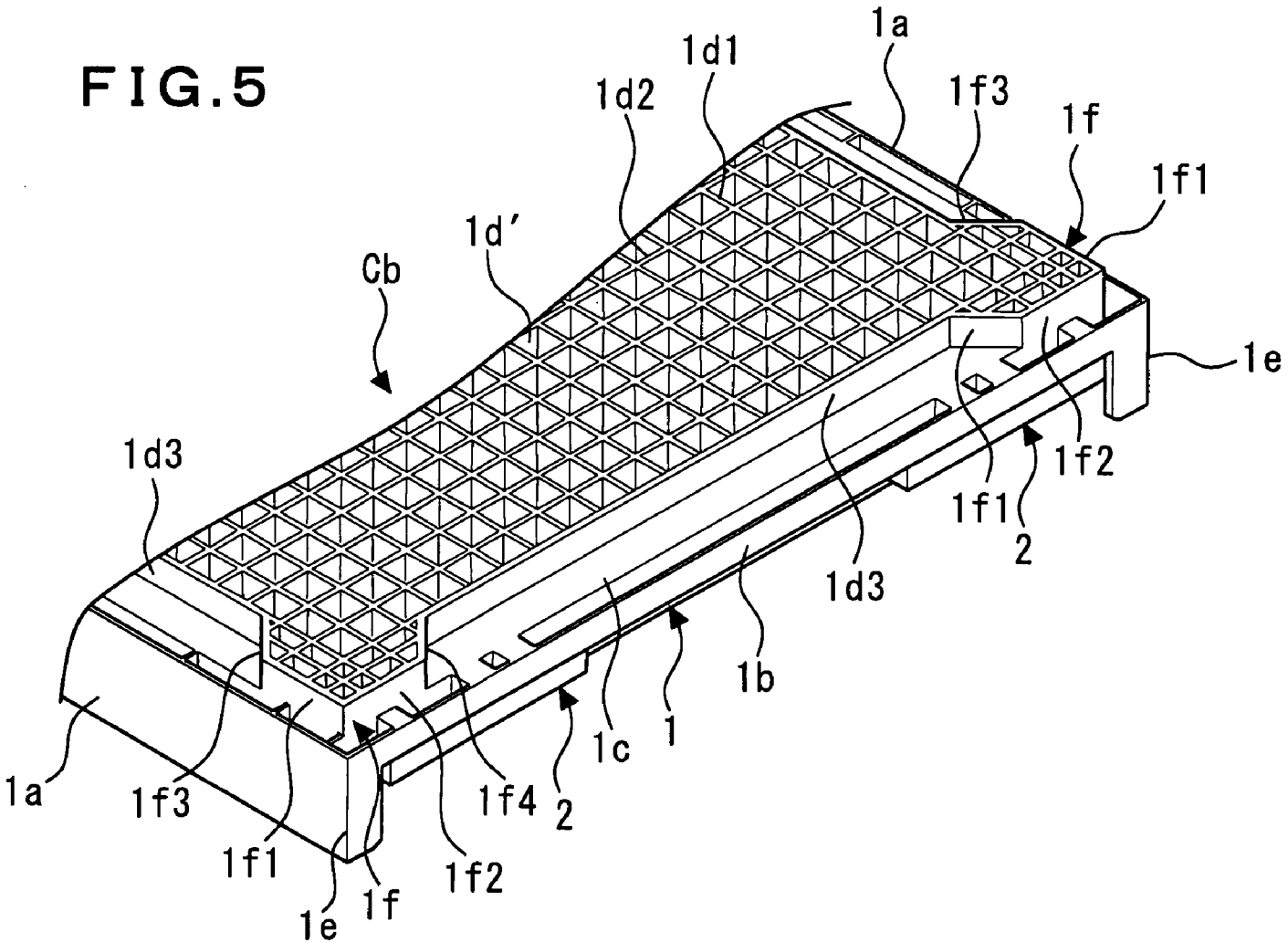
FIG. 5 is a partly enlarged perspective view of the back surface of the bottom of the large folding container shown in FIG. 1.

Then, the bottom 1 will be described with reference to FIGS. 3 to 5.

A back surface of a bottom plate 1*c* is formed with a bottom fitting portion 1*d* having plurality of ribs 1*d*1 that are substantially parallel with the long-side bank portions 1*a* and a plurality of ribs 1*d*2 which are substantially parallel with the short-side bank portions 1*b* and which cross the ribs 1*d*1, the ribs 1*d*1, 1*d*2 extending downward from the back surface of the bottom plate 1*c*. The ribs 1*d*1, 1*d*2 are surrounded with a peripheral frame 1*d*3, and the bottom fitting portion 1*d* is composed of the ribs 1*d*1, 1*d*2 and the peripheral frames 1*d*3.

In the present embodiment, the bottom fitting portion 1*d* is divided into two sub-fitting portions 1*d*' by a groove 4 extending parallel with the short-side bank portions 1*b*. In the present embodiment, since the bottom fitting portion 1*d* is composed of the two sub-fitting portions 1*d*', arranged across the groove 4, the peripheral frames 1*d*3 are also configured to surround the crossing ribs 1*d*1, 1*d*2, which constitute the sub-fitting portions 1*d*'. Four protruding portions 1*f* are formed in respective corner areas of the bottom fitting portion 1*d*, in other words, corner areas of each sub-fitting portion 1*d*' which are closer to corner portions 1*e* of the bottom 1. The protruding portions 1*f* extend toward the corresponding corner portions 1*e* of the bottom 1.

Each of the protruding portions 1*f* has a long side wall portion 1*f*1 extending parallel with the long-side bank portions 1*a* and a short side wall portion 1*f*2 extending parallel with the short-side bank portions 1*b*. Via an inclined portion 1*f*3 extending in the direction of the peripheral frames 1*d*3 forming the bottom fitting portion (sub-fitting portion 1*d*'), the long side wall portion 1*f*1 is connected to the corresponding peripheral frame 1*d*3 located parallel with the long-side bank portions 1*a*. Likewise, via an inclined portion 1*f*4 extending in the direction of the peripheral frames 1*d*3 forming the bottom fitting portion (sub-fitting portion 1*d*'), the short side wall portion 1*f*2 is connected to the corresponding peripheral frame 1*d*3 located parallel with the short-side bank portions 1*b*. The above ribs 1*d*1, 1*d*2 are also formed in a space surrounded by the long side wall portion 1*f*1, the short side wall portion 1*f*2, and the inclined portions 1*f*3, 1*f*4.

Corner blocks 1*g* appearing generally L-shaped in a plan view are formed at respective ends of each long-side bank portion 1*a* of the bottom 1. An inner step portion 1*g*1 is formed in each corner block 1*g*. When folded large folding containers Cb are stacked on one another, each protruding portion 1*f* of the bottom fitting portion 1*d* of the large folding container Cb located above is fitted in the corresponding inner step portion 1*g*1 of the corner block 1*g* formed in the bottom 1 of the large folding container Cb located below.

An engaging concave portion 3*a* extending in a vertical direction is formed in each upper corner area of an outer wall surface (a surface located outside the large folding container Cb when it is assembled into a box shape) of the short side wall 3. A plurality of fitting projections 3*a*1 are formed in each engaging concave portion 3*a*. A horizontally elongate fitting concave portion 3*b* is formed in each upper corner area of an inner wall surface (a surface located inside the large folding container Cb when it is assembled into a box shape) 3' of the short side wall 3. The fitting concave portion 3*b* is formed of a bottom 3*b*1, an inclined portion 3*b*2 formed closer to the center of the short side wall 3, and an interior wall 3*b*3. The fitting concave portion 3*b* is open in its top, inside and end opposite to the inclined surface 3*b*2.

An engaging frame 2*a* is extended from an upper part of each vertical end of the long side wall 2 in the direction of the corresponding short side wall 3. Through-holes 2*a*1 are drilled in the engaging frame 2*a* so that the fitting projections 3*a*1, projected from the above described engaging concave portion 3*a* of the short side wall 3, can be fitted in the respective through-holes 2*a*1. When the large folding container Cb is assembled into a box shape, the engaging frame 2*a*, formed in the upper portion of the vertical end of the long side wall 2, fits into the engaging concave portion 3*a*, formed in the corresponding upper corner area of the adjacent short side wall 3. Furthermore, the fitting projections 3*a*1, projected from the engaging concave portion 3*a* of the short side wall 3, fit into the corresponding through-holes 2*a*1, drilled in the engaging frame 2*a* of the long side wall 2. Consequently, the large folding container Cb assembled into a box shape is not easily collapsed toward the bottom 1.

A horizontally elongate fitting concave portion 2*b* is formed in each upper corner area of an inner wall surface (a surface located inside the large folding container Cb when it is assembled into a box shape) 2' of the long side wall 2, the upper corner area being adjacent to the engaging frame 2*a*. The fitting concave portion 2*b* is formed of a bottom surface 2*b*1, an inclined surface 2*b*2 formed closer to the center of the long side wall 2, an interior wall 2*b*3 and an inner wall surface 2*a*2 of the engaging frame 2*a*. The fitting concave portion 2*b* is open in its top and inside.

When the large folding container Cb is assembled into a box shape, a protruding portion fitting concave portion 5 appearing substantially L-shaped in a plan view is formed in each inner corner of the large folding container Cb, by the corresponding horizontally elongate fitting concave portion 3*b*, formed in the upper corner area of the inner wall surface 3' of the short side wall surface 3, and the corresponding horizontally elongate fitting concave portion 2*b*, formed in the upper corner area of the inner wall surface 2' of the long side wall surface 2.

When large folding containers Cb each assembled into a box shape are stacked on one another in the vertical direction, each protruding portion 1*f* of the bottom fitting portion 1*d* of the bottom 1 of the large folding container Cb located above is fitted into the corresponding protruding portion fitting concave portion 5 of the large folding container Cb located below. Furthermore, those parts of the back surface of the bottom plate 1*c* of the bottom 1 which are located around the periphery of the bottom fitting portion 1*d* of the large folding container Cb located above are placed on a top surface 2" of each long side wall 2 and a top surface 3" of each short side wall 3 of the large folding container Cb located below.

Since the protruding portions 1*f* are formed in the respective corner portions of the bottom fitting portion 1*d* of the bottom 1 as described above, the large folding container Cb can be stably placed on a floor or the like. It is also possible to prevent the corner portions of the bottom 1 from being deformed or buckled by a downward load.

Moreover, when folded large folding containers Cb are stacked on one another in the vertical direction, each protruding portion 1*f* of the bottom fitting portion 1*d* of the bottom 1 of the large folding container Cb located above is fitted into the corresponding inner step portion 1*g*1 of the corner block 1*g* formed in the bottom 1 of the large folding container Cb located below. This limits the horizontal movement of the folded large folding container Cb. Therefore, folded large folding containers Cb can be stably stacked on one another in the vertical direction.

Now, a small folding container Cs will be described with reference to FIGS. 6 to 9. However, the small folding container Cs has substantially the same structure as that of the above described large folding container Cb. Accordingly, the detailed description of the small folding container Cs is omitted. The constituent members of the small folding container Cs which correspond to those of the large-scale folding container Cb are denoted by adding 0 (zero) to each of the reference numbers of the constituent members of the large folding container Cb.

The small folding container Cs is also composed of a bottom 10 that appears rectangular in a plan view, long side walls 20 hinged to corresponding opposite long-side bank portions 10*a* of the bottom 10, and short side walls 30 hinged to corresponding opposite short-side bank portions 10*b* of the bottom 10. The long-side bank portions 10*a* are configured to be higher than the short-side bank portions 10*b*.

The bottom 10 of the small folding container Cs has substantially the same size as that obtained by dividing the bottom 1 of the large folding container Cb into two along the short-side bank portions 1*b*. Each long side wall 20 of the small folding container Cs is substantially as large as each short side wall 3 of the large folding container Cs. Each short side wall 30 of the small folding container Cs has substantially the same size as that obtained by dividing each long side wall 2 of the large folding container Cb into two along vertical sides of the long side wall 2.

As in the case of the bottom 1 of the large folding container Cb, a back surface of the bottom 10 of the small folding container Cs is formed with a bottom fitting portion 10*d* having protruding portions 10*f* in its respective corner portions. Corner blocks 10*g* each having an inner step portion 10*g*1 are formed at respective ends of each long-side bank portion 10*a* of the bottom 10.

The long side wall 20 is formed with engaging frames 20*a* each extending from an upper part of a vertical end of the long side wall 20 in the direction of the corresponding short side wall 30. Through-holes 20*a*1 are drilled in each engaging frame 20*a*. A horizontally long fitting concave portion 20*b* is formed in each upper corner area of an inner wall surface 20' of the long side wall 20, the upper corner area being adjacent to the engaging frame 20*a*.

An engaging concave portion 30*a* is formed in each upper corner area of an outer wall surface of the short side wall 30, and a plurality of fitting projections 30*a*1 are projected from the engaging concave portion 30*a*. A horizontally elongate fitting concave portion 30*b* is formed in each upper corner area of an inner wall surface 30' of the short side wall 30.

Figure 6:
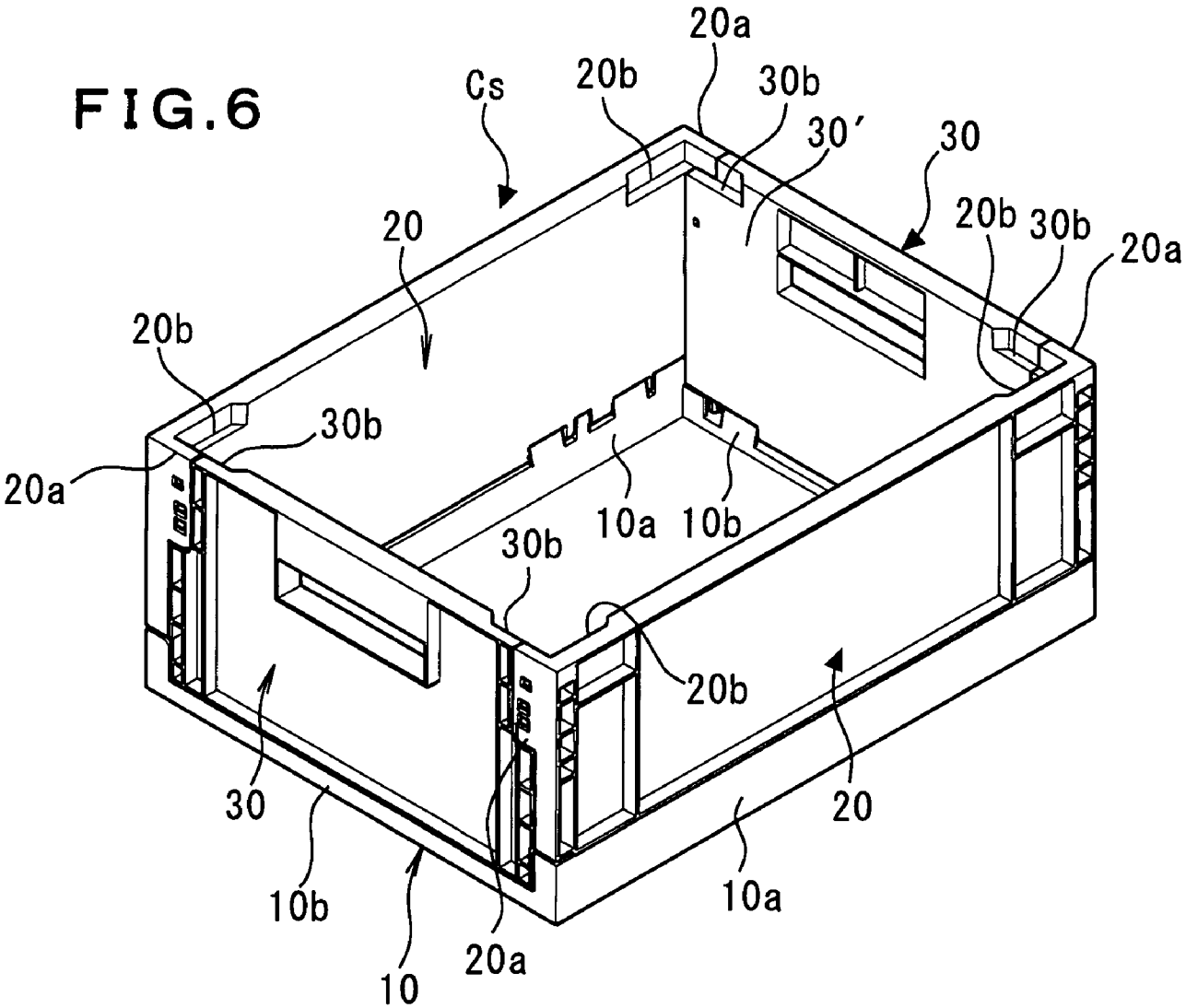
FIG. 6 is a perspective view showing that a small folding container constituting a combined module of a folding container according to the present invention has been assembled into a box shape.
Figure 7:
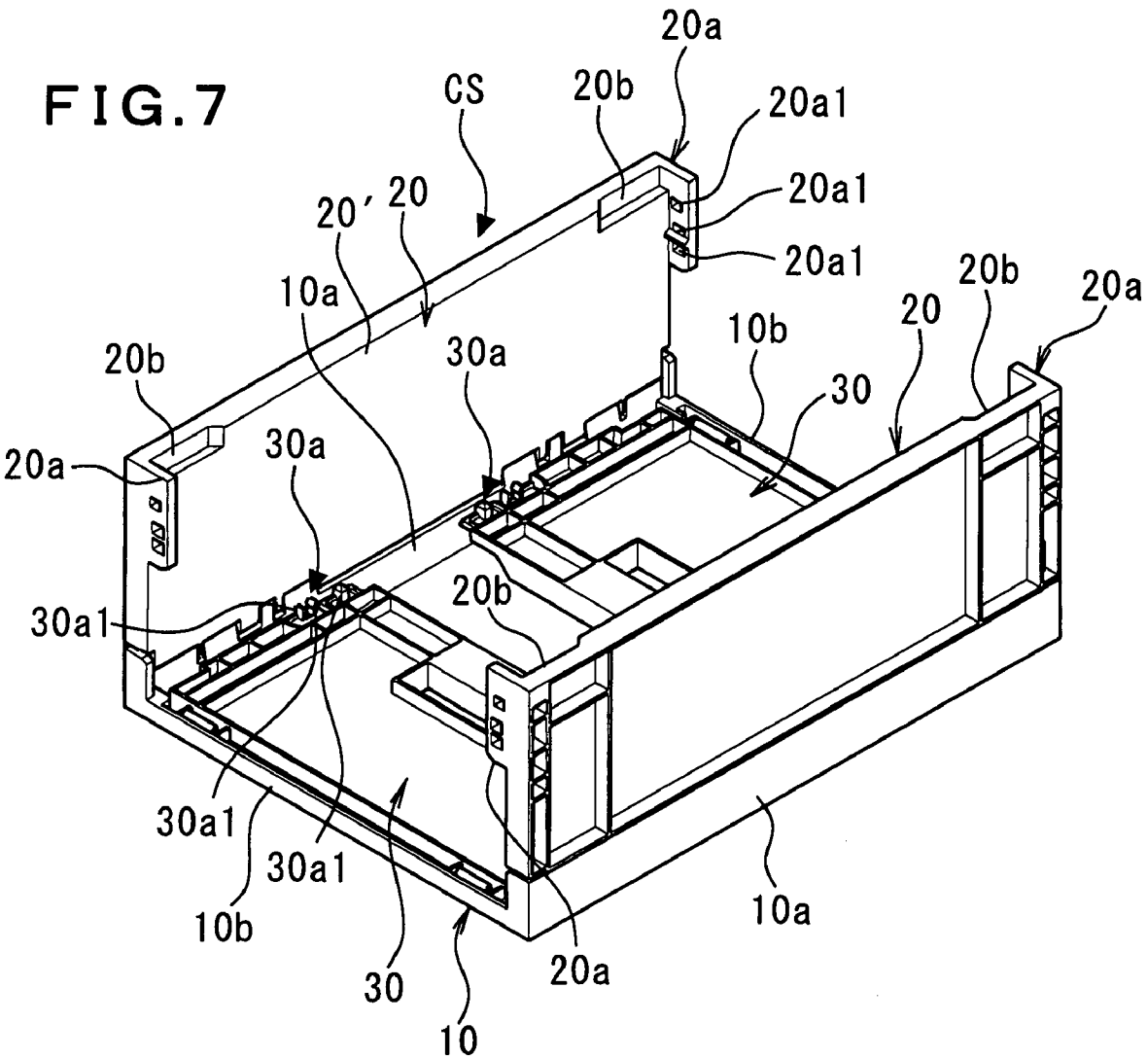
FIG. 7 is a perspective view showing that the small folding container shown in FIG. 6 is being assembled or folded.
Figure 8:
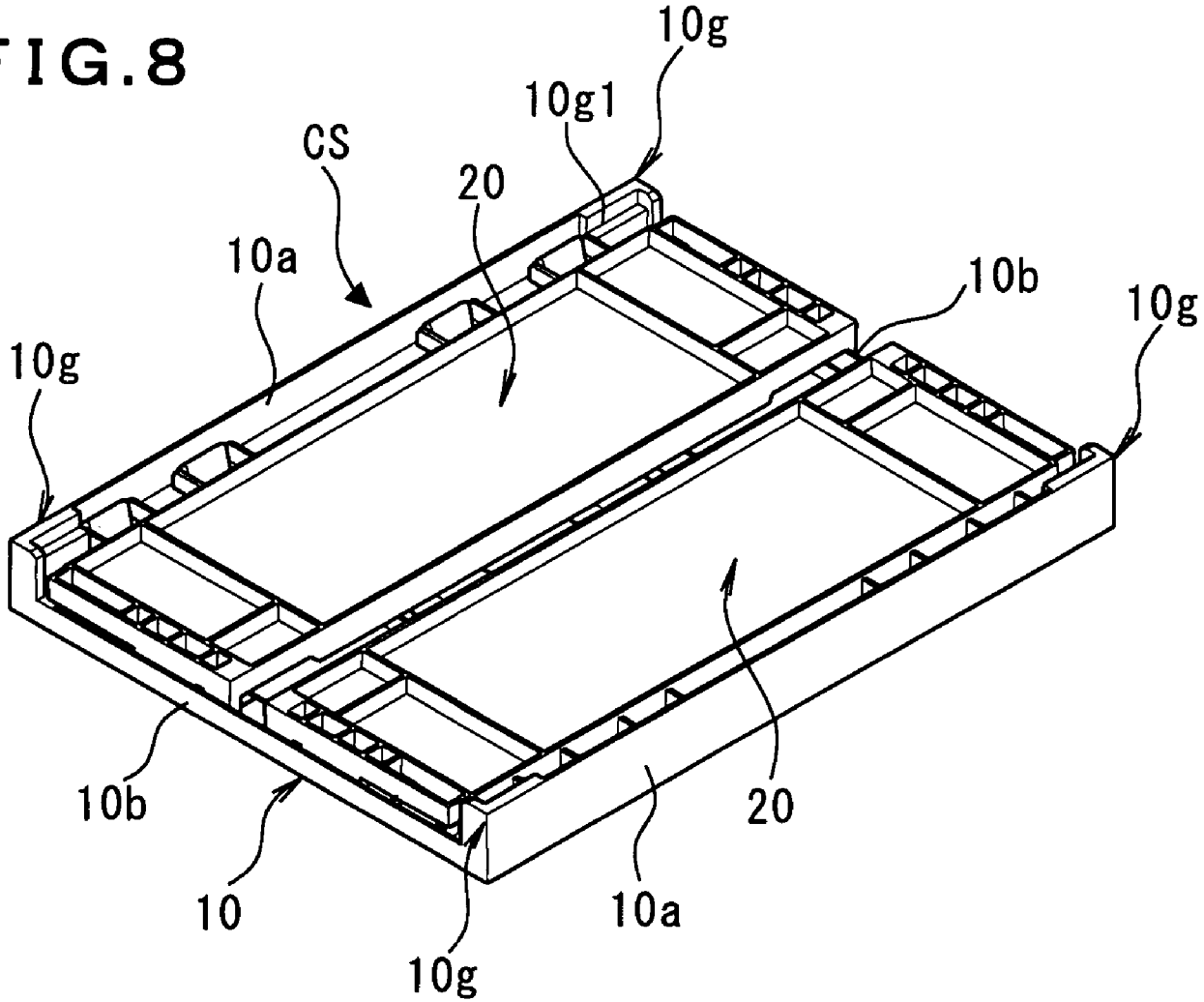
FIG. 8 is a perspective view showing that the small folding container shown in FIG. 6 has been folded.
Figure 9:
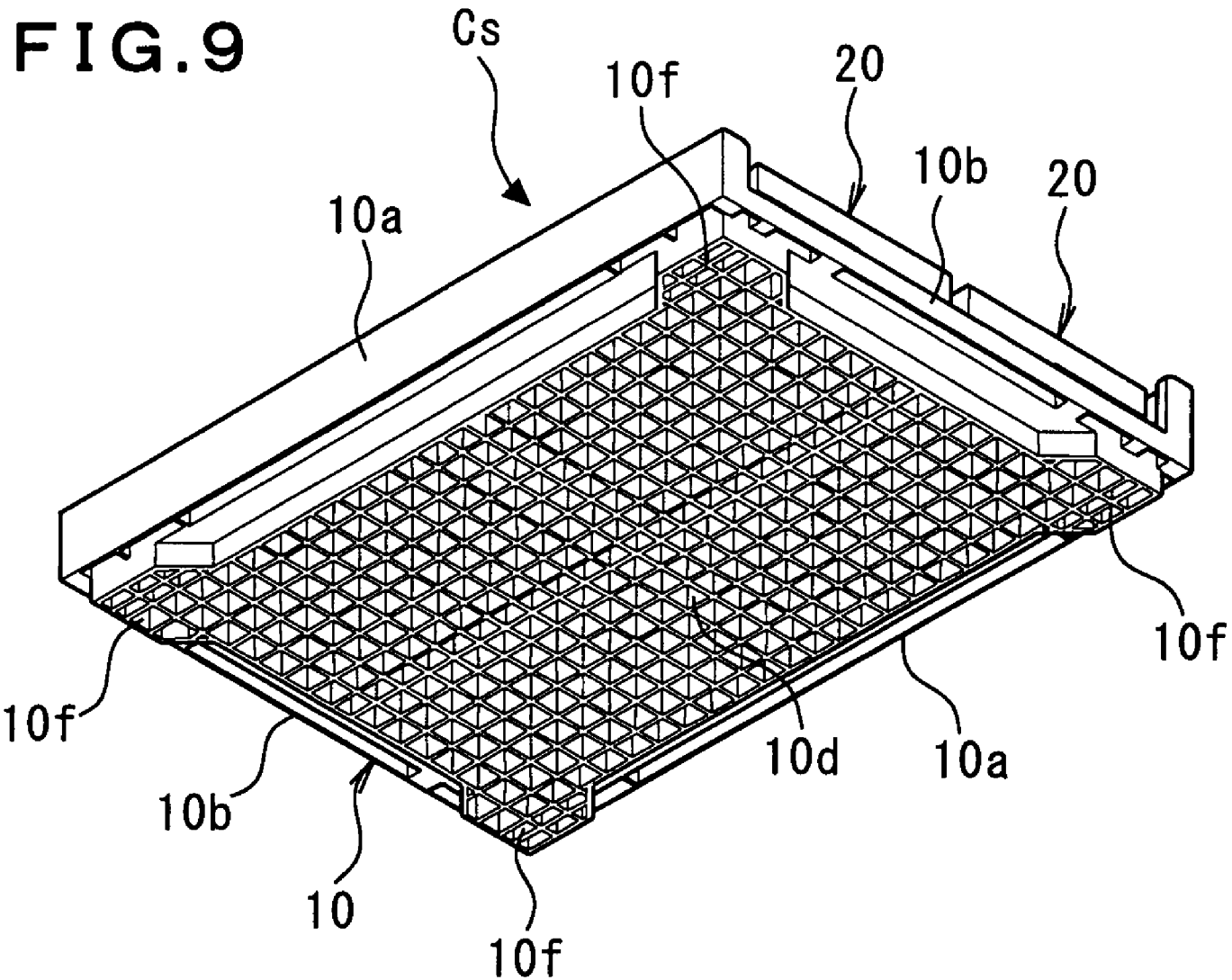
FIG. 9 is a perspective view of a back surface of a bottom of the small folding container shown in FIG. 6.

As in the case of the large folding container Cb, the above described small folding container Cs can be folded by bringing down the short side walls 30 of the small folding container Cs assembled into a box shape as shown in FIG. 6, to the inside of the small folding container Cs to lay them on the bottom 10 as shown in FIG. 7, and then bringing down the long side walls 20 to the inside of the small folding container Cs to lay the long side walls 20 on the bottom 10 and short side wall 30 as shown in FIG. 8.

Figure 10:
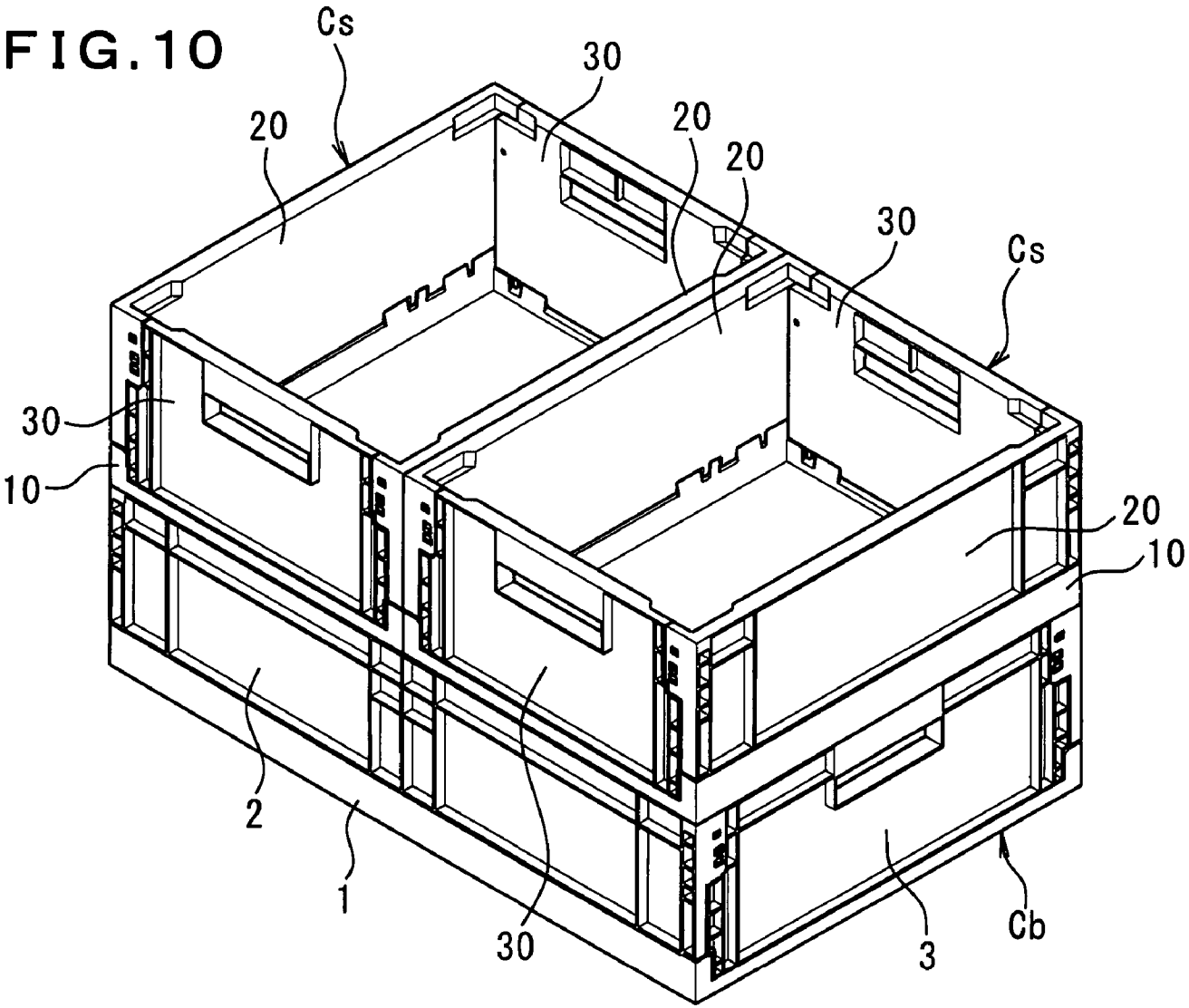
FIG. 10 is a enlarged perspective view showing that small folding containers each in a box state are stacked on the large folding container in a box state, which constitutes the combined module of the folding container according to the present invention.

Furthermore, two small folding containers Cs can be stacked on the large folding container Cb by placing the two small folding containers Cs each assembled into a box shape, on the large folding container Cb also assembled into a box shape so that the short side walls 30 of the small folding container Cs are located on the corresponding long side walls 20 of the large folding container Cb and so that the long side walls 30 of the small folding container Cs are located on the corresponding short side walls 3 of the large folding container Cb, as shown in FIG. 10.

As shown in FIG. 1 and FIG. 2, a concave portion 2*c* that is open in its top and inside is formed in a central portion of the top surface 2" of each long side wall 2 of the large folding container Cb so that the corresponding protruding portions 10*f* of the bottom fitting portions 10*d* each formed on the back surface of the bottom 10 of the small folding container Cs can be fitted into the concave portion 2*c*. Thus, when the two small folding containers Cs each assembled into a box shape are placed on the large folding container Cb also assembled into a box shape, the protruding portions 10*f* of the bottom fitting portions 10*d* each formed on the back surface of the bottom 10 of the small folding container Cs are fitted into the concave protions 2*c* of the large folding container Cb.

Figure 11:
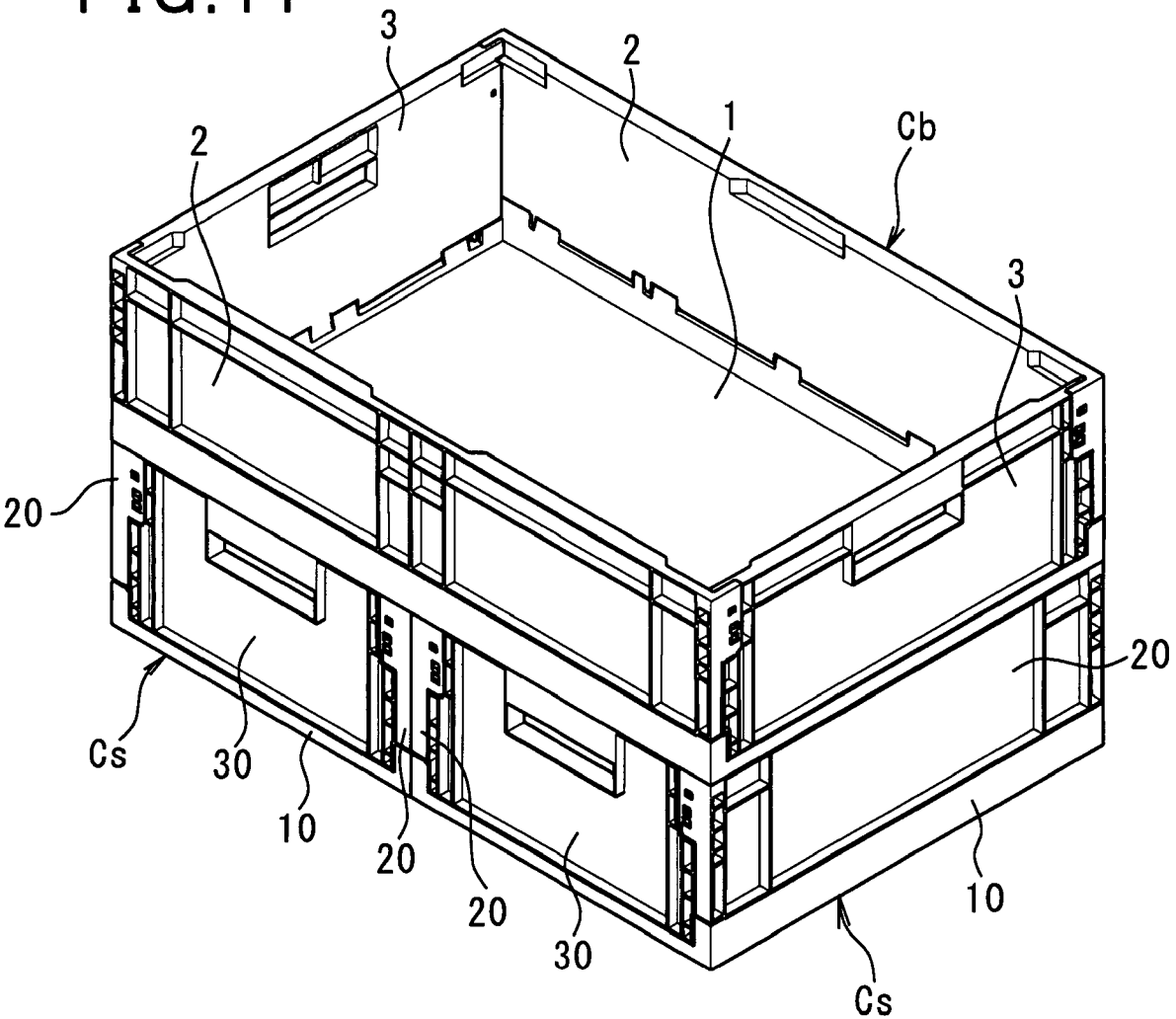
FIG. 11 is an enlarged perspective view showing that the large folding container in a box state is stacked on the small folding containers each in a box state, which constitute the combined module of the folding container according to the present invention.

Similarly, as shown in FIG. 11, the large folding container Cb can placed on two small folding containers Cs arranged so that their corresponding long side walls 20 are contacted with each other. In this case, the top portions of the juxtaposed long side walls 20 of the two small folding containers Cs, located below, are fitted into the groove 4, formed between the sub-fitting portions 1*d'* of the bottom 1 of the large folding container Cb located above.

As described above, in a combined module of the large folding container Cb and the small folding container Cs, the long-side bank portions 1*a* of the bottom 1 of the large folding container Cb are configured to be higher than the short-side bank portions 1*b* of the bottom 1. This improves the strength and rigidity of the bottom 1 of the large folding container Cb. Therefore, the large folding container Cb can be prevented from being deformed or damaged by a load or twist.

Furthermore, the upper end of each long-side bank portion 1*a* of the bottom 1 of the large folding container Cb, including the corner blocks 1*g* formed at the respective ends of each long-side bank portion 1*a*, is preferably formed to be flat like a substantially straight line so that the corner blocks 1*g* do not project upward from the other portions of the long-side bank portion 1*a*, in other words, that part of the long-side bank portion 1*a* which is located between the corner blocks 1*g*. This arrangement further prevents the large folding container Cb from being deformed or damaged by a load or twist.

In the example shown in the above described embodiment, the two small folding containers Cs are stacked on the large folding container Cb. However, three or more small folding containers Cs can be stacked on the large folding container Cb by properly setting the size of the small folding container Cs relative to the large folding container Cb.

The present invention is configured as described above and thus produces the effects described below.

The long-side bank portions 1*a* of the bottom 1 of the large folding container Cb are configured to be higher than the short-side bank portions 1*b* of the bottom 1. This improves the strength and rigidity of the bottom 1 of the large folding container Cb. Therefore, the large folding container Cb can be prevented from being deformed or damaged by a load or twist.

The invention claimed is:

1. A combined module of a large folding container and a small folding container, wherein said large folding container comprises a bottom section, long-side walls hinged to corresponding long-side bank portions of the bottom section, and short-side walls hinged to corresponding short-side bank portions of the bottom section, wherein said long-side walls are configured to be longer than said short-side walls, said long-side bank portions are configured to be higher than said short-side bank portions, a back surface of the bottom section of the large folding container is formed with a bottom fitting portion, and said bottom fitting portion is divided into sub-fitting portions by a groove extending parallel with said short-side bank portions, and said sub-fitting portions are surrounded by a peripheral frame; and said peripheral frame includes a long-side wall portion that is substantially parallel with and spaced apart from each of said long-side bank portions, a short-side wall portion that is substantially parallel with and spaced apart from each of said short-side bank portions of said frame, and four extending portions formed in respective corner areas of said bottom fitting portion and horizontally extending away from said long-side wall portion and said short-side wall portion side of said peripheral frame and towards said corner of said bottom, wherein said extending portions connect each of said long-side wall portions to said short-side wall portions, and a distance between said extending portions and said bank portions of said bottom is less than the distance between said long and short-side wall portions of said peripheral frame and said bank portions of said bottom; and said small folding container comprises a small folding container bottom section, small folding container long-side walls hinged to corresponding small folding container long-side bank portions of the small folding container bottom section, and small folding container short-side walls hinged to corresponding small folding container short-side bank portions of the small folding container bottom section, wherein said small folding container long-side walls are configured to be longer than said small folding container short-side walls, said small folding container long-side bank portions are configured to be higher than said small folding container short-side bank portions, and a small folding container back surface of the small folding container bottom section of the small folding container is formed with a bottom fitting portion, and each of said extending portions of the bottom fitting portion of the large folding container is fitted into a fitting concave portion formed in the respective small folding containers when the large folding container and the small folding containers are assembled into a box shape and stacked on one another.

* * * * *